US009456637B2

(12) United States Patent
Fligel

(10) Patent No.: US 9,456,637 B2
(45) Date of Patent: Oct. 4, 2016

(54) MATERNITY SUPPORT GARMENT

(71) Applicant: Garan, Incorporated, New York, NY (US)

(72) Inventor: David M. Fligel, New York, NY (US)

(73) Assignee: GARAN, INCORPORATED, New York, NY (US)

( * ) Notice: Subject to any disclaimer, the term of this patent is extended or adjusted under 35 U.S.C. 154(b) by 358 days.

(21) Appl. No.: 14/272,100

(22) Filed: May 7, 2014

(65) Prior Publication Data

US 2015/0320121 A1 Nov. 12, 2015

(51) Int. Cl.
*A41C 1/10* (2006.01)

(52) U.S. Cl.
CPC ..... *A41C 1/10* (2013.01)

(58) Field of Classification Search
CPC ..... A41C 1/10; A41D 1/20; A41D 1/06; A41D 1/062
USPC ..... 2/104, 69, 227, 228, 238, 409, 401, 2/403, 406, 236, 237, 221, 220, 76, 2/78.1–78.3; 450/94–117; 128/99.1, 128/100.1, 101, 1
See application file for complete search history.

(56) References Cited

U.S. PATENT DOCUMENTS 2,513,039 A * 6/1950 Miller ..... A41B 9/004 2/406
2,638,597 A * 5/1953 Troxell ..... A41D 1/20 2/211
2,763,009 A * 9/1956 Blatt ..... A41C 1/10 2/407
2,854,006 A * 9/1958 Geimer ..... A41C 1/10 450/117
3,054,112 A * 9/1962 McMann ..... A41D 1/20 2/76
3,694,816 A * 10/1972 Smith ..... A41B 11/14 2/409
5,465,594 A * 11/1995 Imboden ..... D04B 1/243 2/239
5,787,512 A * 8/1998 Knox ..... A41B 11/14 2/409
6,247,185 B1 * 6/2001 Gardon-Mollard .... A41B 11/14 2/239
7,171,775 B1 * 2/2007 Lacorte ..... F41G 1/38 42/122
7,181,775 B2 2/2007 Carney
D583,529 S * 12/2008 Gardner, III ..... D2/704
D600,881 S * 9/2009 Naylor ..... D2/731
7,676,852 B1 3/2010 Carney
7,814,575 B2 * 10/2010 Hendrickson ..... A41D 1/20 2/227
D627,538 S * 11/2010 Naylor ..... D2/704
8,191,177 B1 6/2012 Carney
RE43,531 E * 7/2012 Hendrickson ..... 2/227
8,235,766 B2 * 8/2012 Melarti ..... A41C 1/10 2/69
8,276,216 B2 * 10/2012 Carney ..... A41D 1/20 2/311
8,864,551 B2 * 10/2014 Melarti ..... A41C 1/10 450/7
8,968,051 B1 * 3/2015 Carney ..... A41D 1/20 2/220
9,044,051 B1 * 6/2015 Rydman ..... A41D 1/06
9,119,426 B1 * 9/2015 Skanron ..... A41D 1/20

(Continued)

*Primary Examiner* — Gloria Hale
(74) *Attorney, Agent, or Firm* — Epstein Drangel LLP; Robert L. Epstein

(57) ABSTRACT

A maternity support garment for encircling the torso of the wearer, including the belly. The garment includes a seamless non-cylindrical stretchable knit fabric body with a non-uniform circumference, spaced top and bottom bands and a front panel, a rear panel, and side panels extending between the bands. The height of the front panel is larger than the height of the rear panel so as to create a pouch adapted to receive and support the belly of the wearer and to accommodate the belly of the wearer as the size of the belly changes. The front panel includes Jersey stitching. The back panel is formed of micro-ribbed knitted fabric. The side panels are formed of 1×1 mesh stitching. The top and bottom bands are made of 2×1 ribbed fabric including 215 denier elastane (Spandex®).

19 Claims, 4 Drawing Sheets

(56) References Cited

U.S. PATENT DOCUMENTS 9,314,023 B2 * 4/2016 Arimori ..... A01N 43/713
D754,948 S * 5/2016 Cockram ..... D2/853
2002/0152775 A1 * 10/2002 Browder, Jr. ..... A41B 9/001 66/170
2004/0210987 A1 * 10/2004 Carney ..... A41D 1/20 2/236
2006/0010571 A1 * 1/2006 Oakley ..... A41D 1/062 2/227

* cited by examiner

MATERNITY SUPPORT GARMENT

BACKGROUND OF THE INVENTION

1. Field of the Invention

The present invention relates to support undergarments and more particularly to a seamless undergarment designed for use by women during and after pregnancy which is fabricated of knit material with excellent stretch and recovery characteristics, and provides light ergonomic support, particularly in the belly area and for lower back, as well as superior comfort.

2. Description of Prior Art Including Information Disclosed Under 37 CFR 1.97 and 1.98

It is well known that women require varying sized garments to provide comfort and an attractive appearance during successive stages of pregnancy. Accordingly, new garments must be acquired periodically to accommodate for the changing shape of the wearer. It is often necessary for special garments, which are solely of use during pregnancy, to be purchased.

A maternity support garment should help distribute the abdominal weight during pregnancy. It should help reduce pregnancy-related back pain. It should also alleviate aches associated with abdominal stretching.

There have been several attempts to provide clothing garments which adjust to the shape of the wearer during pregnancy. Many are made of a stretchy fabric and/or involve the use of physically adjustable garments. Those garments are provided with a plurality of adjustment points such as snaps that allow the wearer to periodically adjust the size of the garment. The disadvantages of such garments are principally that they are not attractive, require some effort to adjust their size, and they are normally not useable after pregnancy.

An attempt to provide a continually adjustable clothing garment has involved including in the garment one or more shirred panels located in the front of the garment where major expansion capability is required. The panels of such garments have included concertina folds of the material of the garment connected by an elastic thread or the like. The panels allow expansion by extension of the concertina folds. One of the main disadvantages of those garments is that large quantities of material are needed for the concertina folds. In addition, the panels are relatively bulky, are uncomfortable and unattractive and, in addition, have only limited extension capability beyond which further expansion is impossible. Moreover, garments having substantially rigid rear panels provide insufficient support for the back of the wearer, particularly when the wearer leans forward.

Various other types of maternity undergarments have been sold in the market. Some of those garments support the lower torso and lower back lifting the weight off the pelvis and shifting it to the shoulders and back but do not smooth the lines on the thigh and leg or waist. Others act as a separate piece to be used over undergarments in a support function, lifting the belly and redistributing the weight from the belly to the shoulders and the back but do not provide a girdle function. Still others products function has a girdle on the lower torso supporting the belly and smoothing the thighs but do not address the waist area or bust. Finally, there is a tube slip product that acts only as a skirt girdle smoothing the thigh area but offers no support and does not address the upper torso.

Also available are many belly belt or band products which are intended to be worn over non-pregnancy clothing to disguise the fact that the wearer has become too large to fit into her regular pants and shirts. Those garments are cylindrically shaped tubes made of elastic material having a uniform circumference and are fabricated of the same stitch pattern throughout. While those products are advertised as being useful from the beginning of pregnancy through the post-partum period, they provide little in the way of support. The uniform construction does not allow for increased support for areas requiring same, such as the belly and lower back, nor do they include additional stretching where it is required for comfort.

Finally, typical maternity undergarments create unsightly panty lines or do not cover, smooth, or shape the thigh, back, waist and leg the way support-top pantyhose might in non-maternity garments. With the surge in contemporary and fashionable maternity clothes on the market, there is a need for an undergarment that acts as a body smoother to create smooth lines at the thigh and buttocks and back waist, creating a better fit and supporting the look and feel of more fashionable maternity clothes.

It is therefore a prime object of the present invention to provide a maternity support garment which provides support and comfort at all stages of pregnancy and during the post-partum period.

It is another object of the present invention to provide a maternity support garment which is formed of a seamless, non-cylindrical body with a non-uniform circumference.

It is another object of the present invention to provide a maternity support garment which is formed of a knit fabric blend.

It is another object of the present invention to provide a maternity support garment which includes an increased size, expandable front panel forming a pouch to accommodate the belly of the wearer as it enlarges over pregnancy.

It is another object of the present invention to provide a maternity support garment in which the front panel is formed of a knit fabric blend incorporating Jersey stitching.

It is another object of the present invention to provide a maternity support garment which includes a ribbed back panel for additional comfort and support.

It is another object of the present invention to provide a maternity support garment which includes mesh stitched side panels.

It is another object of the present invention to provide a maternity support garment which includes top and bottom bands of ribbed knit blend material with additional elasticity.

It is another object of the present invention to provide a maternity support garment which provides a smooth appearance without unsightly panty lines.

It is another object of the present invention to provide a maternity support garment which covers and shapes the belly, back and waist.

BRIEF SUMMARY OF THE INVENTION

In general, the above objects are achieved by the present invention which relates to a maternity support garment is provided for encircling the torso of the wearer, including the belly of the wearer. The garment includes a seamless, non-cylindrical stretchable knit fabric body with a non-uniform circumference.

The body includes spaced top and bottom bands. The front panel, rear panel and side panels extend between the top and bottom bands. The height of the front panel, measured between the top band and bottom band at the front of the garment, is larger than the height of the rear panel, measured between the top band and bottom band at the rear of the garment. That height difference creates a pouch adapted to receive and support the belly of the wearer and to accommodate the belly of the wearer as the size of the belly changes.

The back panel is formed of ribbed knitted fabric for lower back support and comfortable fit. The side panels are formed of knitted fabric with mesh stitching for comfort and fit. The top and bottom bands are made of ribbed knitted fabric with additional elastic properties.

In accordance with another aspect of the present invention, a maternity support garment is provided for encircling the torso of the wearer, including the belly. The garment includes a seamless non-cylindrical stretchable knit fabric body with a non-uniform circumference, including spaced top and bottom bands. The front panel, rear panel, and side panels extend between the bands. The front panel defines a pouch adapted to receive and support the belly of the wearer and to accommodate the belly as the size of the belly changes. The back panel is formed of ribbed knitted fabric for lower back support and comfortable fit.

The side panels are formed of knitted fabric with mesh stitching for comfort and fit. The top and bottom bands are made of ribbed fabric material with additional elastic properties.

In accordance with another aspect of the present invention, a maternity support garment is provided for encircling the torso of the wearer including the belly of the wearer, the garment has a seamless non-cylindrical stretchable knit fabric body with a non-uniform circumference including spaced top and bottom bands. The front panel, rear panel, and side panels extend between the bands. The front panel defines a pouch adapted to receive and support the belly of the wearer and to accommodate the belly as the size of the belly changes. The side panels are formed of stretchable knitted fabric with mesh stitching for increased expandability.

The back panel is formed of ribbed knitted fabric for lower back support and comfortable fit. The top and bottom bands are made of ribbed fabric material with additional elastic properties.

In accordance with another aspect of the present invention, a maternity support garment is provided for encircling the torso of the wearer including the belly of the wearer. The garment includes a seamless non-cylindrical stretchable knit fabric body with a non-uniform circumference including spaced top and bottom bands. The front panel, rear panel, and side panels extend between the bands. The front panel defines a pouch adapted to receive and support the belly of the wearer and to accommodate the belly of the wearer as the size of the belly changes. The top and bottom bands are made of ribbed fabric material with additional elastic properties.

The back panel is formed of ribbed knitted fabric for lower back support and comfortable fit. The side panels are formed of knitted fabric with mesh stitching for comfort and fit.

In accordance with another aspect of the present invention, a maternity support garment is provided for encircling the torso of the wearer including the belly of the wearer. The garment includes a seamless non-cylindrical stretchable knit fabric body with a non-uniform circumference, including spaced top and bottom bands. A front panel, a rear panel, and side panels extend between the bands. The height of the front panel from the top band to the bottom band, measured along the front of the body, is larger than the height of the rear panel between the top band and the bottom band, measured along the rear of the body, so as to create a pouch adapted to receive and support the belly of the wearer and to accommodate the belly of the wearer as the size of the belly changes. The front panel includes Jersey stitching. The back panel is formed of micro-ribbed knitted fabric. The side panels are formed of 1×1 mesh stitching. The top and bottom bands are made of 2×1 ribbed fabric material including 215 denier elastane (Spandex®).

BRIEF DESCRIPTION OF THE SEVERAL VIEWS OF DRAWINGS

To these and to such other objects that may hereinafter appears, the present invention relates to a maternity support garment as described in detail in the following specification and recited in the annexed claims, taken together with the accompanying drawings, in which like numerals refer to like parts and in which:

DETAILED DESCRIPTION OF THE INVENTION

Figure 1:
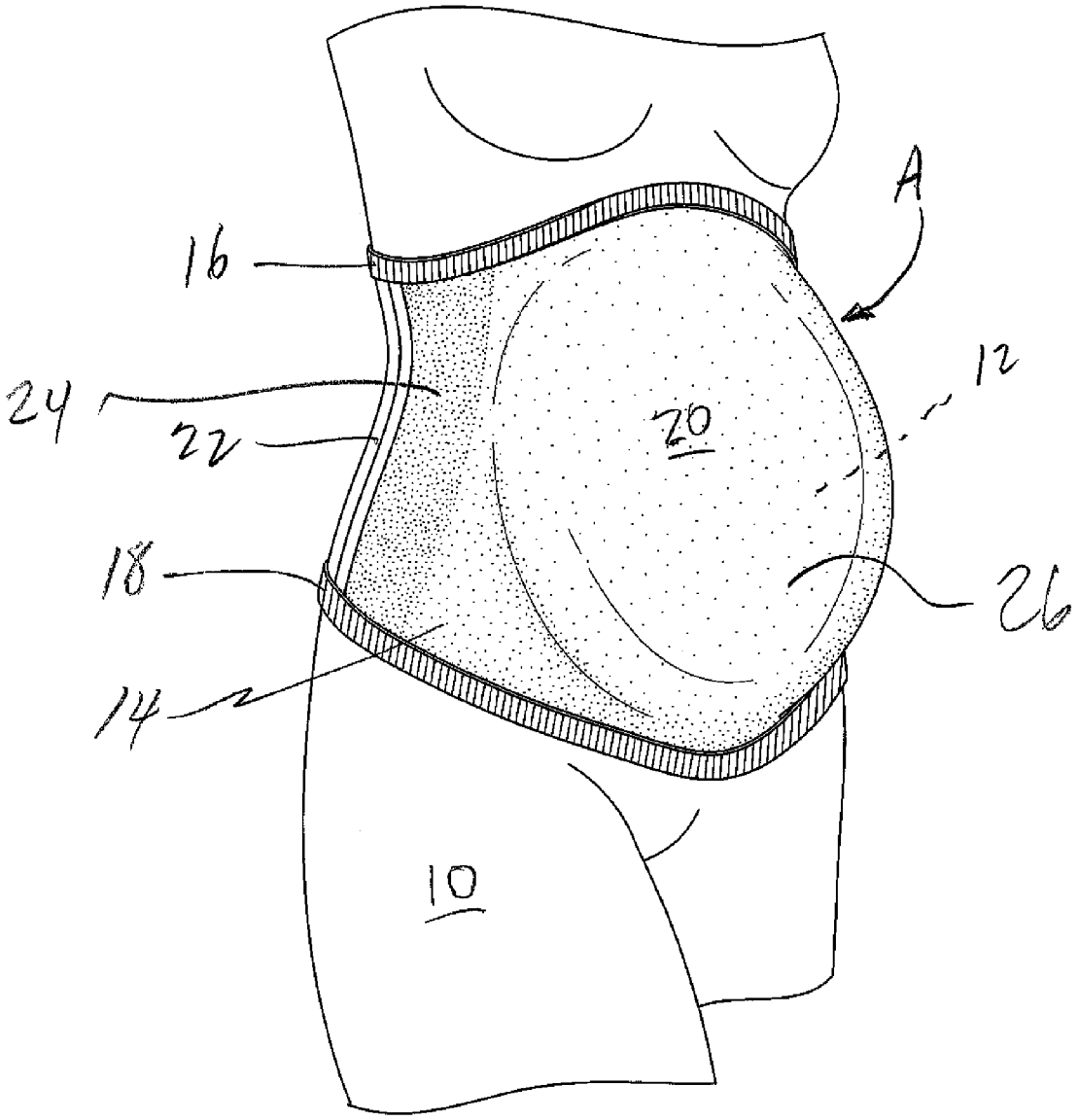
FIG. 1 is a perspective view of the maternity support garment of the present invention.
Figure 2:
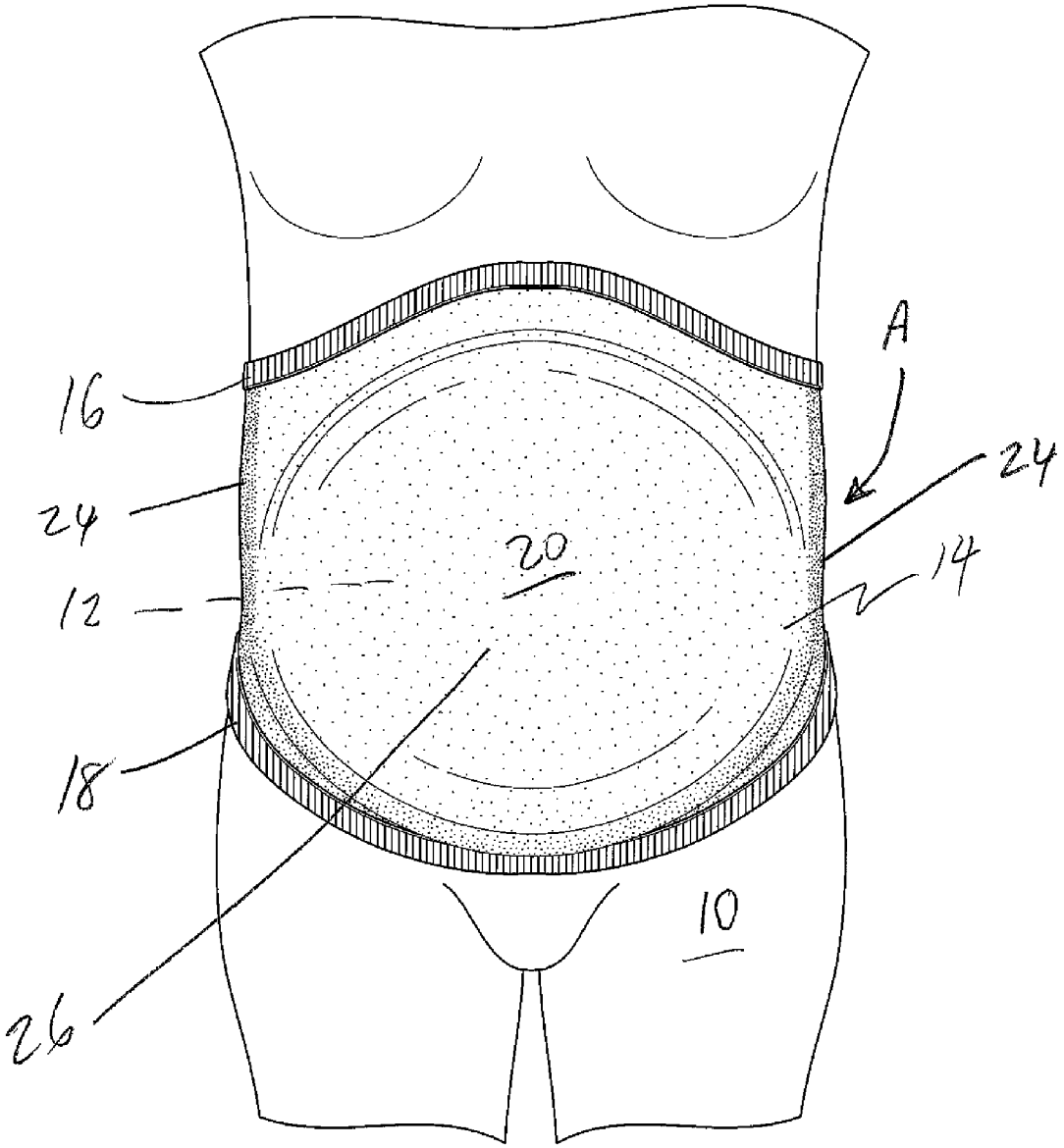
FIG. 2 is a front elevation view of the maternity support garment of the present invention.
Figure 3:
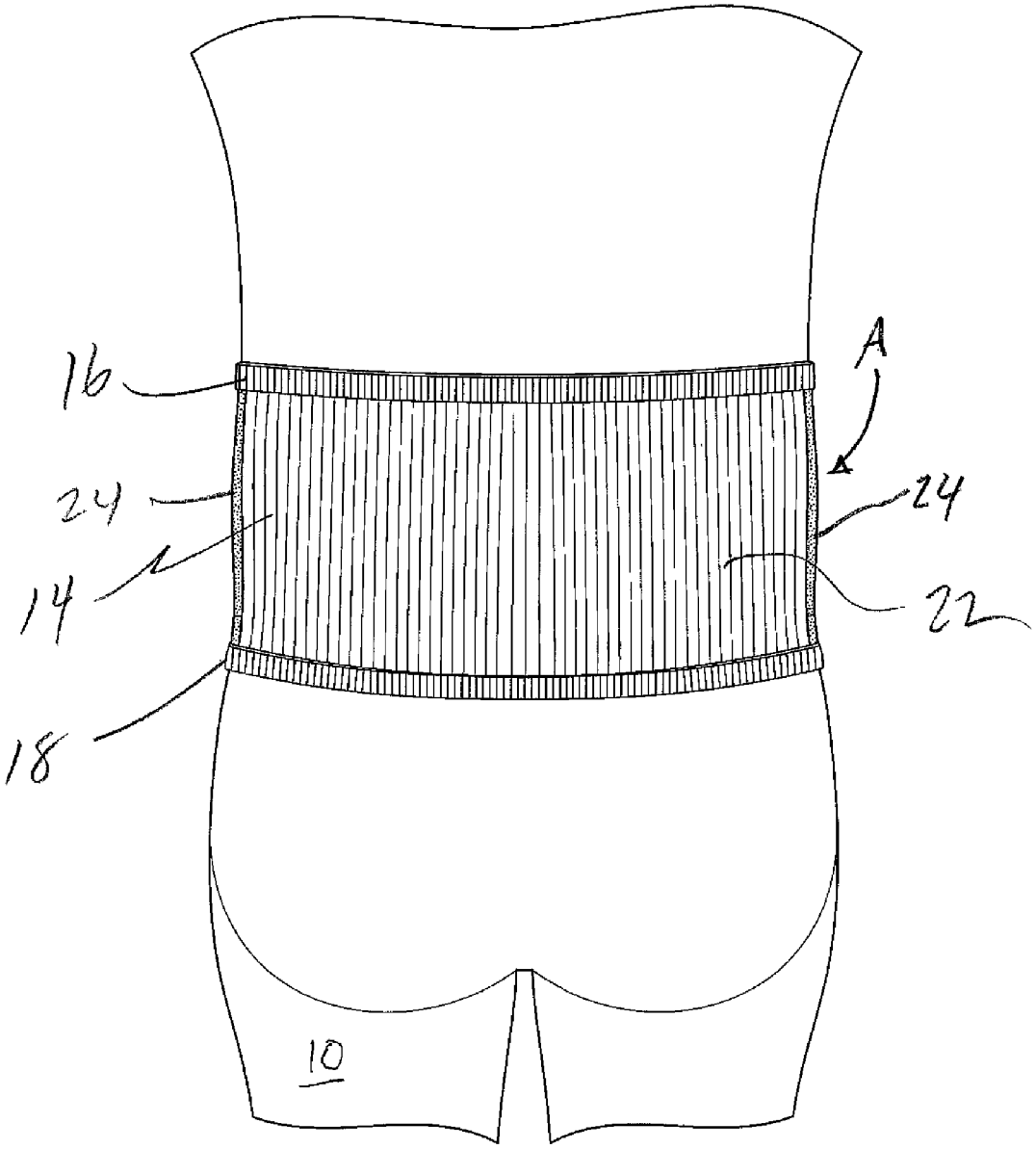
FIG. 3 is a rear elevation view of the maternity support garment of the present invention.

As illustrated in the drawings, the maternity support garment of the present invention, generally designated A, is intended to encircle the torso of the wearer 10, including the belly 12. The garment has a seamless non-cylindrical stretchable knit fabric body 14 with a non-uniform circumference, including spaced top and bottom bands 16, 18. The front panel 20, rear panel 22, and side panels 24 extend between bands 16 and 18.

Figure 4:
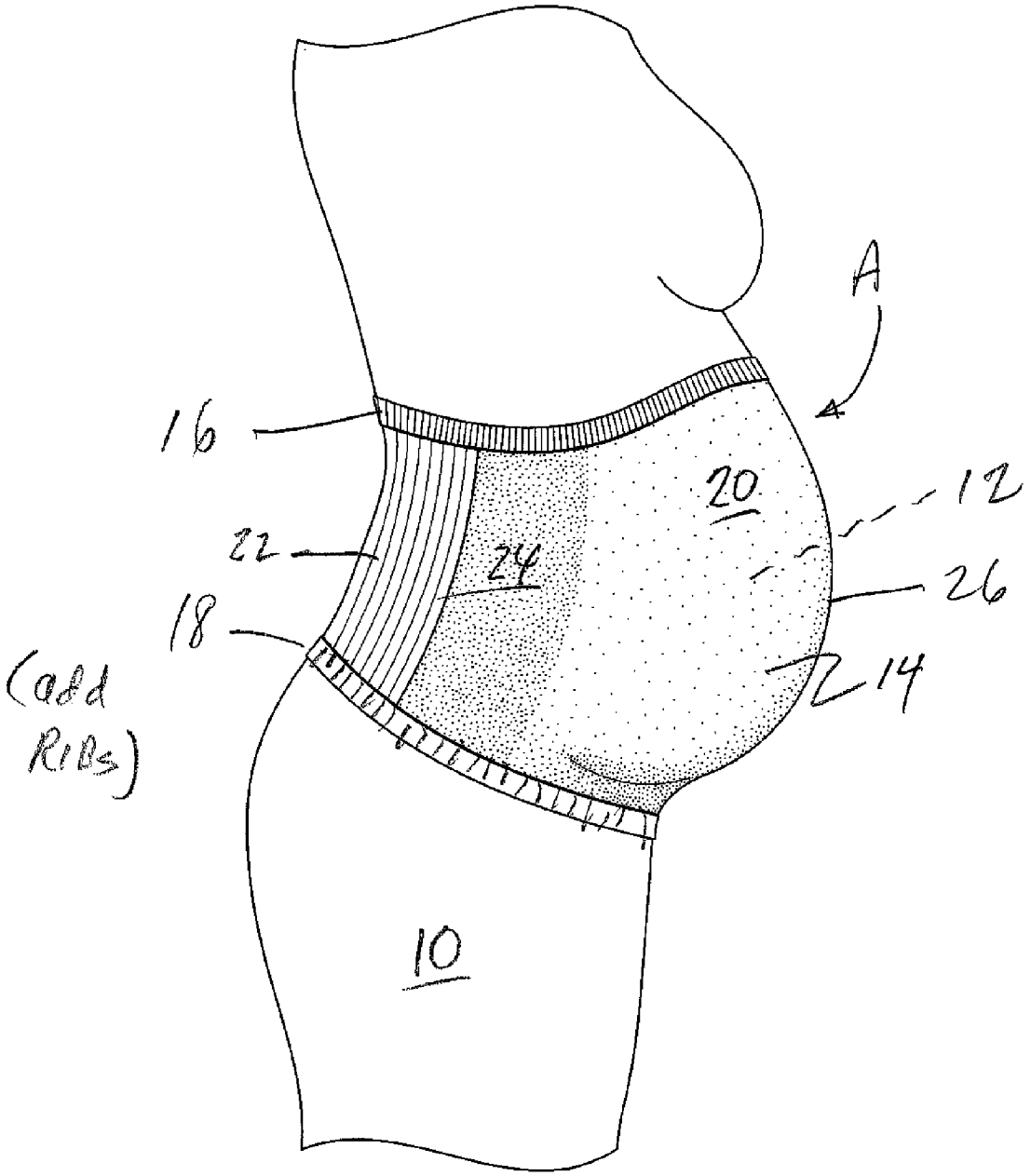
FIG. 4 is an elevation view showing one side of the maternity support garment of the present invention.

The front panel 20 defines a pouch 26 adapted to receive and support the belly 12 of wearer 10 and to accommodate belly 12 as the size of the belly changes. As illustrated in FIG. 4, the height of front panel 20, measured between top band 16 and bottom band 18 at the front of the garment, is larger than the height of rear panel 22, measured between top band 16 and bottom band 18, at the rear of the garment. That height difference creates pouch 26 adapted to receive and support belly 12 and to accommodate the belly as the size of the belly changes.

Front panel 20, including pouch 26, is knitted using a Jersey stitch which provides excellent stretch, recovery and comfort across the belly.

Back panel 22 is formed of micro-ribbed knitted fabric for increased lower back support and comfortable fit.

Side panels 24 are formed of knitted fabric with smoothing 1×1 mesh stitching for comfort and fit.

Top and bottom bands 16, 18 are preferably 1 inch wide formed of 2×1 ribbed knitted fabric with increased elastic properties for superior comfort and support. Those increased elastic properties result from incorporating 215 denier elastane (Spandex®) into the fabric.

While only a single preferred embodiment of the present invention has been disclosed for purposes of illustration, it is obvious that many modifications and variations could be made thereto. It is intended to cover all of those modifications and variations which fall within the scope of the present invention, as defined by the following claims.

I claim:

1. A maternity support garment for encircling the torso of the wearer including the belly of the wearer which has a size, the garment comprising a seamless non-cylindrical stretchable knit fabric body with a non-uniform circumference including spaced top and bottom bands, a front panel having a height from the top band to the bottom band measured along the front of the body, a rear panel having a height from the top band to the bottom band measured along the rear of the body, a first side panel, and a second side panel extending between the bands, wherein the height of the front panel is larger than the height of the rear panel so as to create a pouch adapted to receive and support the belly of the wearer and to accommodate the belly of the wearer as the size of the belly changes.

2. The garment of claim 1 wherein the back panel is formed of ribbed knitted fabric for lower back support and comfortable fit.

3. The garment of claim 1 wherein the side panels are formed of knitted fabric with mesh stitching for comfort and fit.

4. The garment of claim 1 wherein the top and bottom bands are made of ribbed fabric material with additional elastic properties.

5. The garment of claim 1 wherein the front panel is includes Jersey stitching.

6. A maternity support garment for encircling the torso of the wearer including the belly of the wearer which has a size, the garment comprising a seamless non-cylindrical stretchable knit fabric body with a non-uniform circumference including spaced top and bottom bands, a front panel, a rear panel, a first side panel, and a second side panel extending between the bands, wherein the front panel defines a pouch adapted to receive and support the belly of the wearer and to accommodate the belly of the wearer as the size of the belly changes, and the back panel is formed of micro-ribbed knitted fabric for lower back support and comfortable fit.

7. The garment of claim 6 wherein the side panels are formed of knitted fabric with mesh stitching for comfort and fit.

8. The garment of claim 6 wherein the top and bottom bands are made of ribbed fabric material with additional elastic properties.

9. A maternity support garment for encircling the torso of the wearer including the belly of the wearer which has a size, the garment comprising a seamless non-cylindrical stretchable knit fabric body with a non-uniform circumference including spaced top and bottom bands, a front panel, a rear panel, a first side panel, and a second side panel extending between the bands, wherein the front panel defines a pouch adapted to receive and support the belly of the wearer and to accommodate the belly of the wearer as the size of the belly changes, and the side panels are formed of stretchable knitted fabric with mesh stitching for increased expandability.

10. The garment of claim 9 wherein the side panels are formed of 1×1 mesh stitching.

11. The garment of claim 9 wherein the back panel is formed of ribbed knitted fabric for lower back support and comfortable fit.

12. The garment of claim 9 wherein the top and bottom bands are made of ribbed fabric material with additional elastic properties.

13. A maternity support garment for encircling the torso of the wearer including the belly of the wearer which has a size, the garment comprising a seamless non-cylindrical stretchable knit fabric body with a non-uniform circumference including spaced top and bottom bands, a front panel, a rear panel, a first side panel, and a second side panel extending between the bands, wherein the front panel defines a pouch adapted to receive and support the belly of the wearer and to accommodate the belly of the wearer as the size of the belly changes, and wherein the top and bottom bands are made of ribbed fabric material with additional elastic properties.

14. The garment of claim 13 wherein the top and bottom bands are 1 inch wide.

15. The garment of claim 13 wherein the top and bottom panels are formed of 2×1 ribbed fabric.

16. The garment of claim 13 wherein the top and bottom bands include 215 denier elastane (spandex).

17. The garment of claim 13 wherein the back panel is formed of ribbed knitted fabric for lower back support and comfortable fit.

18. The garment of claim 13 wherein the side panels are formed of knitted fabric with mesh stitching for comfort and fit.

19. A maternity support garment for encircling the torso of the wearer including the belly of the wearer which has a size, the garment comprising a seamless non-cylindrical stretchable knit fabric body with a non-uniform circumference including spaced top and bottom bands, a front panel having a height from the top band to the bottom band measured along the front of the body, a rear panel having a height from the top band to the bottom band measured along the rear of the body, a first side panel, and a second side panel extending between the bands, wherein the height of the front panel is larger than the height of the rear panel so as to create a pouch adapted to receive and support the belly of the wearer and to accommodate the belly of the wearer as the size of the belly changes, wherein the front panel includes Jersey stitching, the back panel is formed of micro-ribbed knitted fabric, the side panels are formed of 1×1 mesh stitching, the top and bottom bands are made of 2×1 ribbed fabric material including 215 denier elastane (spandex).

* * * * *